United States Patent [19]

Weigel et al.

[11] 4,362,561

[45] Dec. 7, 1982

[54] METHOD FOR THE SMELTING OF MATERIAL SUCH AS ORE CONCENTRATES

[75] Inventors: Horst Weigel; Gerhard Melcher, both of Cologne, Fed. Rep. of Germany

[73] Assignee: Klockner-Humboldt-Deutz AG, Fed. Rep. of Germany

[21] Appl. No.: 152,592

[22] Filed: May 23, 1980

[30] Foreign Application Priority Data

May 31, 1979 [DE] Fed. Rep. of Germany ..... 2922189

[51] Int. Cl.[3] ..... C22B 15/00

[52] U.S. Cl. ..... 75/92; 75/74

[58] Field of Search ..... 75/23, 92, 72, 73, 74, 75/75

[56] References Cited

U.S. PATENT DOCUMENTS

| | | | |
|---|---|---|---|
| 2,784,076 | 3/1957 | Greenawalt | 75/20 R |
| 3,222,162 | 12/1965 | Beals et al. | 75/73 |
| 3,563,726 | 2/1971 | Elvander | 266/162 |
| 4,017,307 | 4/1977 | Winterhager et al. | 75/72 |
| 4,127,408 | 11/1978 | Weigel et al. | 75/76 |
| 4,247,087 | 1/1981 | Suprunor | 75/74 |

*Primary Examiner*—M. J. Andrews

*Attorney, Agent, or Firm*—Hill, Van Santen, Steadman, Chiara & Simpson

[57] ABSTRACT

Method and apparatus for smelting an ore concentrate or the like in which the concentrate is first melted in an oxidizing atmosphere and the smelt is thereafter treated with reducing gases to recover the metal values. One of the features of the present invention resides in conducting the after-treatment by means of blowing reducing gases into the smelt with a plurality of separate lances to provide a lighter slag phase and a heavier metal-containing phase, and separately withdrawing the slag phase and the metal containing phase from the furnace. In a particularly preferred embodiment of the invention, the smelt is aftertreated in the sequence involving first blowing an oxidizing gas thereon, then blowing a neutral gas thereon, and finally blowing a reducing gas thereon prior to separating the slag phase from the metal phase.

7 Claims, 1 Drawing Figure

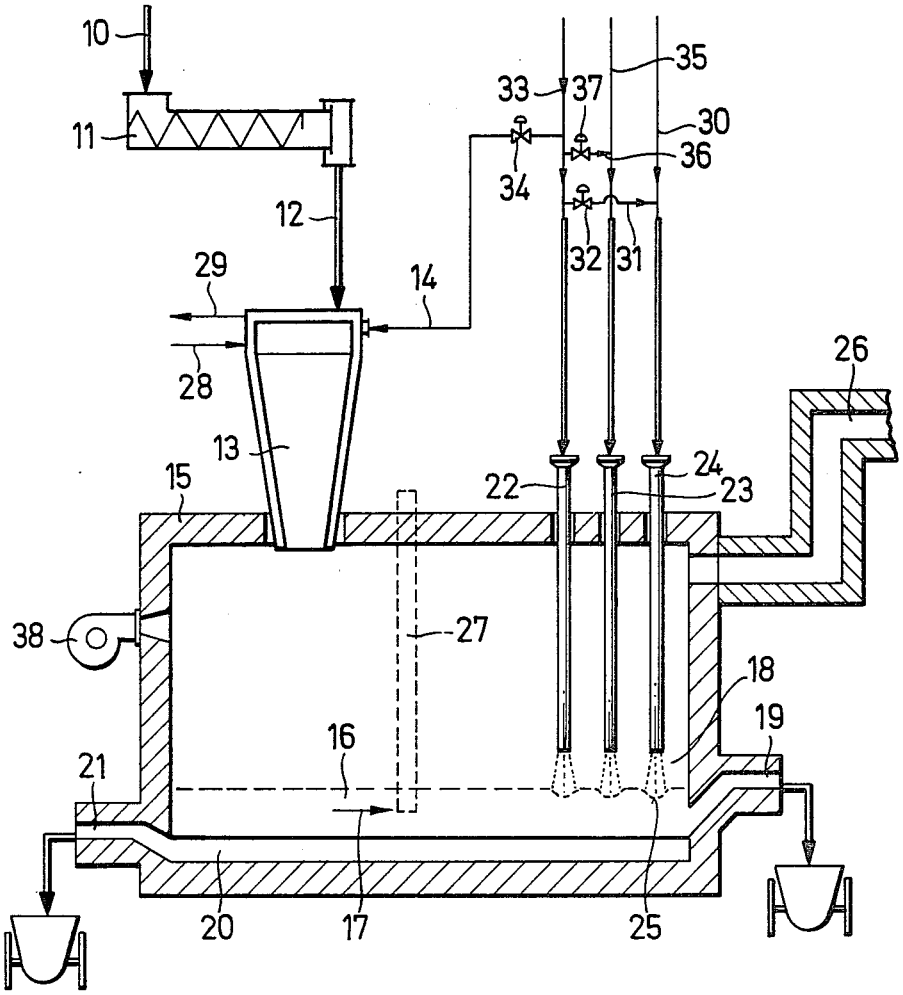
10
11
12
13
14
15
16
17
18
19
20
21
22
23
24
25
26
27
28
29
30
31
32
33
34
35
36
37
38

METHOD FOR THE SMELTING OF MATERIAL SUCH AS ORE CONCENTRATES

BACKGROUND OF THE INVENTION

1. Field of the Invention

This invention is in the field of smelting ore concentrates, particularly sulfide type materials in a first calcining and smelting operation wherein the concentrate is calcined and then smelted, following by an aftertreatment in which the smelt is reduced to produce the metal as a molten layer, with an overlying slag layer, the two layers being capable of separation while still being in the treating furnace.

2. Description of the Prior Art

In a known pyrometallurgical method described in German OS No. 2,348,105, fine-grained sulfur-containing ore concentrates are introduced into a cyclone reactor into which an oxygen-rich gas is blown through a tangentially discharging supply line. The ore concentrate is continuously calcined and melted in the cyclone reactor in the turbulent conditions existing in the reactor. The smelt is collected below the cyclone reactor and consists of a lighter slag phase and a heavier metal phase such as copper matte. This smelt is then metallurgically aftertreated by means of reducing gases which are blown onto the smelt through a lance so that metal oxides which are contained in the slag phase are converted into droplets of metal matte. With such an aftertreatment with reduction gas under these conditions, the lighter slag phase still contains relatively large amounts of metal in admixture with the smelt, so the two mixed phases are withdrawn to another location where they are subsequently separated from each other by means of a separate centrifuge. Beyond the reduction of the oxides, no other aftertreatment of the melt is carried out with the known top blowing technique.

SUMMARY OF THE INVENTION

The present invention provides a method for smelting particularly sulfidic ore concentrates including a smelting reactor and a reactor for aftertreatment of the smelt involving a plurality of blowing lances under conditions such that slag conditioning is carried out under optimum conditions and material transfer as well as heat transfer are carried out quickly. The result is a process which is characterized by a high space-time yield and the lighter slag phase and the heavier metal-containing phase no longer need be separated by means of a separate centrifuge.

In accordance with the method of the present invention, the aftertreatment of the smelt is carried out by blowing gases through a plurality of spaced lances under conditions sufficient to form relatively fluid slag and heavier metal-containing phases which can be conveniently withdrawn from separate discharge areas in the reactor housing.

In accordance with the present method, the gases are continuously blown onto the smelt through a plurality of top blowing lances in the form of concentrated streams of high kinetic energy. These high energy streams are continuously introduced to the phase boundary layer between the slag and the smelt and thoroughly mix the two so that heat transfer and material transfer proceed in the reactor at high velocities with the result that the lighter slag phase and the heavier metal-containing phase can be separately withdrawn from the reactor quickly without the necessity of providing a separate centrifuge.

In a further embodiment of the present invention, the reduction gases which are blown onto the smelt are mixed with oxygen in less than stoichiometric amounts with regard to oxidation of the reduction gases so that the reduction reaction can be precisely controlled in terms of reduction potential to achieve a specific, selective degree of refining. Each lance thus provides a separate reaction system, and the smelt slowly flowing under the lances is continuously reduced in a step-by-step reaction when the lances are fed with reduction gases having different reduction potentials.

In a further form of the invention, other gases such as neutral gases and/or combustible gases and/or oxidizing gases can be blown onto the smelt in addition to the normal reduction gases. If combustible gases are also blown onto the molten bath in addition to the reduction gases, heat is transmitted to the molten bath at the point where they strike the hot molten bath surface due to combustion, so that a separate heating device such as an electrical resistance heating can be eliminated for the top blowing reactor. Consequently, the combustible gas can be blown onto the molten bath in very close proximity to those locations at which the reduction gas is provided, thereby achieving a precise, desired reduction temperature for the smelt as well as a desired degree of volatility for the reaction. This leads to high mass transfer velocities.

In another feature of the invention, the combustible gases can be blown onto the smelt mixed with oxygen or air where the atmosphere in the top blowing reactor no longer contains sufficient oxygen for burning the combustible gas in the area in which the combustible gas is introduced onto the smelt.

A further feature of the invention involves blowing oxidizing gases onto the molten bath to achieve complete oxidation of any sulfur which was not converted in the melt aggregate to sulfur dioxide.

In a particularly preferred embodiment of the invention, the molten stream of material proceeds along the longitudinal dimension of the furnace assembly, and is successively contacted by, first, an oxidizing atmosphere by means of a first lance or group of lances, second by a neutral atmosphere by a second lance or lance group, and, finally, a reducing atmosphere which is generated by a third blowing lance or group of lances. With this arrangement, it is not necessary to isolate different atmospheres because the gases are blown onto the molten bath in the form of concentrated streams with high kinetic energy, so that the various mass and heat transfers occur before the atmospheres can become mixed.

BRIEF DESCRIPTION OF THE DRAWINGS

The single FIGURE of the drawings illustrates somewhat schematically a furnace assembly which can be used for the purposes of the present invention.

DESCRIPTION OF THE PREFERRED EMBODIMENTS

The invention, together with additional advantages and features are explained in greater detail in the embodiment of the invention schematically illustrated in the drawing.

The drawing illustrates a pyrometallurgical furnace installation for smelting fine-grained sulfidic copper ore concentrate which is supplied together with other reactants to a conveying element 11 by means of an inlet 10. The conveying element 11 supplies the materials through a line 12 to the top of a melting cyclone 13 into which a stream 14 of technically pure oxygen is blown in tangentially. The line 12 can also discharge directly into the oxygen blow line 14. The feed material is calcined and melted in the smelting cyclone 13 which is positioned above a furnace housing 15. The raw material is heated very rapidly to high temperatures in a matter of fractions of seconds while it is still in suspension or in a highly turbulent state. The combustion of the sulfur and other oxidizable components in the oxygen atmosphere usually supply sufficient heat in order to permit the calcining and melting processes to proceed autogenously.

In addition to sulfidic copper ore concentrates, other non-ferrous metal-containing ores or concentrates as well as residues and slags of metallurgical processes can be processed in the type of furnace installation of the present invention in order to produce metal-enriched products.

A smelt 16 collects below the smelting cyclone 13 in the furnace housing 15, the smelt 16 flowing in the direction of the arrow 17 into a top blowing reactor zone 18 which is also part of the furnace housing 15. An overflow weir 19 discharges slag off the floor of the housing 15 beyond the reaction zone 18. The heavier, metal-containing phase illustrated at reference numeral 20 is withdrawn through an outlet 21 on the opposite side of the furnace assembly 15, the level of outlet 21 being lower than the slag overflow weir 19.

The top blowing reactor zone 18 is equipped with perpendicular top blowing lances 22, 23 and 24 through which fresh reaction gas is continuously introduced to the phase boundary between the slag and the smelt in the form of a concentrated stream with high kinetic energy. The velocity of the gases is controlled such that a spattering of the bath is avoided. The lances 22, 23 and 24 are preferably adjustable in height in order to make it possible to precisely adjust the optimum degree of blow impression 25 on the surface of the molten bath. The waste gas is withdrawn together with dust and metal vapors which have formed by means of a waste gas line 26 and is directed from there to a gas cleansing installation (not shown) and then to a condenser for the precipitation of metal vapors and, if necessary, to a waste heat furnace for the combustion of remaining combustible gas components of the waste gas.

A partition 27 (indicated in broken lines) may be immersed into the smelt 16 between the smelting reactor 13 and the reaction zone 18 containing the top blowing lances 22, 23 and 24 to separate the oxidizing atmosphere in the smelting zone from the reducing atmosphere in the reaction zone. In this instance, the smelting portion of the furnace installation 15 should be equipped with its own waste gas exit line.

If the smelting cyclone 13 is operated with air, the inside temperature of the cyclone is approximately 1500° C. With oxygen being used as the oxidizing gas, the temperature rises to about 2000° C. In both cases, the melting cyclone 13 is cooled as by means of connecting the same to a water inlet line 28 for circulation of water which is withdrawn by means of a cooling water return line 29. If a partition 27 is provided in the furnace assembly, this partition can also be water cooled.

The top blowing lances 22, 23 and 24 are shown as spaced with approximately equal intervals in the longitudinal direction of the furnace. These lances can also be water cooled. The melting cyclone 13, the partition 27 and the top blowing lances can obviously, if desired, be connected to a common cooling system for water recirculation.

Reducing gases enter through an inlet line 30 and can consist of a gaseous hydrocarbon such as propane. The reduction gas or gases can be mixed with oxygen in less than stoichiometric amounts to accurately pre-set the reduction potential, the oxygen being derived by means of a line 31 and a valve 32 from a main oxygen line 33. The oxygen feed line 14 connects to the main feed line 33 through a valve 34. By mixing controlled proportions of oxidizing gas with reducing gas, specific, selective refining of the smelt can be carried out.

A combustible gas is introduced through a line 35 and is blown on the smelt 16 through the lance 23, the combustible gas being brought to combustion at its point of striking the hot surface of the molten bath so that an optimum heat transfer to the molten bath is achieved. With endothermic reduction processes, exactly the desired reduction temperature for the smelt can be pre-set and the desired volatilization reaction can be controlled. If the atmosphere in the top blowing reactor 18 no longer contains sufficient oxygen in the area of the discharge of the lance 23 for burning the combustible gas, then air or oxygen can be branched off from the main oxygen line 33 by means of a line 36 controlled by a valve 37 to be added to the combustible gas in the line 35.

The furnace may also be provided with an additional burner 38 in one wall of the furnace housing 15 to supply hot gases for compensating for heat losses. Oxidizing gases are blown onto the smelt 16 through the lance 22 so that the lance 22 is simply connected to the main oxygen line 33. The remaining sulfur in the form of sulfide which is not converted to sulfur dioxide in the melting cyclone 13 as well as other oxidizable components can be re-oxidized in the molten bath.

Viewed in the direction of the arrow 17, from the smelt collecting space to the discharge 19, the first lance 22 or group of lances generates an oxidizing atmosphere, the second lance 23 or group of lances generates a neutral atmosphere and the third lance 24 or group thereof can generate a reducing atmosphere so that all possible conditions for treating the slag with respect to mass transfer as well as to heat transfer can be obtained in an optimum manner.

It is also possible to substitute a flash smelting unit for the smelting cyclone 13.

The following specific example illustrates conditions of operation when utilizing a Partition 27 in the furnace:

EXAMPLE I

| | | |
|---|---|---|
| Input: | | |
| Concentrate | | 1000 kg/h |
| —Cu | | 25% |
| —Fe | | 30% |
| —S | | 33% |
| Quartz | Slag forming elements | 110 kg/h |
| Lime | mixed with concentrate | 60 kg/h |
| Oxygen-cyclone | | 240 $Nm^3/h$ |
| Propane | Top blowing lance | 26 $Nm^3/h$ |
| Oxygen | gas mixture | 64 $Nm^3/h$ |
| Output: | | |
| Copper matte | | 325 kg/h |
| —Cu | | 72% |

-continued

| | |
|---|---|
| —Fe | 5% |
| Slag | 660 kg/h |
| —Cu | 0.5% |
| —Fe | 43% |
| —$SiO_2$ | 28% |
| CaO | 9% |
| Dust cyclone | 48 kg/h |
| —Cu | 13% |
| Waste gas cyclone | 270 $Nm^3/h$ |
| —$SO_2$ | 67% |
| Dust/top blowing reactor | 7 kg/h |
| Waste gas/top blowing reactor before afterburning | 200 $Nm^3/h$ |

The following example illustrates the conditions obtaining in a furnace installation without Partition 27:

EXAMPLE II

| | |
|---|---|
| Concentrate analysis: | |
| Cu | 23.5% |
| Fe | 30.7% |
| S | 32.0% |
| $SiO_2$ | 5.2% |
| CaO | 0.9% |
| Input: | |
| Concentrate | 182 t/Day |
| Silica sand | 29 t/Day |
| Limestone | 18 t/Day |
| Mixture | 229 t/Day |
| Oxygen 95% $O_2$ (Cyclone + Lances) | 215 $Nm^3/t$ mixture |
| Propane (Lances) | 7 $Nm^3/t$ mixture |
| Output: | |
| Copper matte | 58 t/Day |
| Cu | >70% |
| Slag | 129 t/Day |
| Cu | 0.5% |
| Waste gas before afterburning | 215 $Nm^3/t$ mixture |

It will be evident that various modifications can be made to the described embodiments without departing from the scope of the present invention.

We claim as our invention:

1. In a method for smelting an ore concentrate or the like in which said concentrate is first melted in an oxidizing atmosphere and the smelt is aftertreated with reducing gases to recover the metal values, the improvement which comprises:

melting said concentrate in substantially pure oxygen at a temperature of from 1500° to 2000° C., conducting the aftertreating by blowing reducing gases containing a mixture of a hydrocarbon fuel gas and oxygen, said oxygen being present in less than stoichiometric proportions, onto the smelt by means of a plurality of separate lances under conditions of high kinetic energy to create a blow impression under each lance, the reduction potential of the gases blown by each lance varying from one lance to the next, thereby producing a lighter slag phase and a heavier metal containing phase and separately withdrawing said slag phase and said metal-containing phase.

2. A method according to claim 1 in which:

said reducing gases increase in reduction potential from lance to lance in the direction of smelt flow.

3. A method according to claim 1 in which:

said reduction gases are combined with neutral gases and the gas mixture is blown onto said smelt.

4. A method according to claim 1 in which:

said reduction gases are combined with additional combustible gases and the gas mixture is blown onto said smelt.

5. A method according to claim 1 in which:

said reduction gases are combined with oxidizing gases and the gas mixture is blown onto said smelt.

6. A method according to claim 4 in which:

said additional combustible gases are pre-mixed with an oxidizing gas before being combined with said reduction gases.

7. A method according to claim 1 in which:

the smelt is aftertreated in a sequence of (a) blowing an oxidizing gas thereon, (b) blowing a neutral gas thereon, and (c) blowing reducing gas thereon prior to separation of said slag phase from said metal phase.

* * * * *